US008936391B2

(12) United States Patent
Stoeckli et al.

(10) Patent No.: US 8,936,391 B2
(45) Date of Patent: Jan. 20, 2015

(54) STATIC MIXER

(75) Inventors: Rochus Stoeckli, Buochs (CH); Wilhelm A. Keller, Merlischachen (CH)

(73) Assignee: Medmix Systems AG, Rotkreuz (CH)

( * ) Notice: Subject to any disclaimer, the term of this patent is extended or adjusted under 35 U.S.C. 154(b) by 909 days.

(21) Appl. No.: 13/131,550

(22) PCT Filed: Nov. 19, 2009

(86) PCT No.: PCT/CH2009/000371

§ 371 (c)(1),
(2), (4) Date: May 26, 2011

(87) PCT Pub. No.: WO2010/060225

PCT Pub. Date: Jun. 3, 2010

(65) Prior Publication Data

US 2011/0228631 A1 Sep. 22, 2011

(30) Foreign Application Priority Data

Nov. 27, 2008 (CH) ..... 1855/08

(51) Int. Cl.
*B01F 5/06* (2006.01)
*B01F 13/00* (2006.01)
*B01F 15/00* (2006.01)

(52) U.S. Cl.
CPC ..... *B01F 13/002* (2013.01); *B01F 5/0641* (2013.01); *B01F 15/0087* (2013.01); *B01F 2215/0034* (2013.01)
USPC ..... 366/337; 366/340

(58) Field of Classification Search
USPC ..... 366/337, 340
See application file for complete search history.

(56) References Cited

U.S. PATENT DOCUMENTS

| | | | | |
|---|---|---|---|---|
| 3,328,003 | A | 6/1967 | Chisholm | |
| 5,851,067 | A | 12/1998 | Fleischli et al. | |
| 5,944,419 | A | 8/1999 | Streiff | |
| 2003/0048694 | A1 | 3/2003 | Horner et al. | |
| 2008/0232191 | A1 * | 9/2008 | Keller | 366/339 |
| 2010/0097883 | A1 * | 4/2010 | Habibi-Naini | 366/337 |

FOREIGN PATENT DOCUMENTS

EP 0815929 B1 8/2000

OTHER PUBLICATIONS

PCT International Search Report on application No. PCT/CH2009/000371 dated Nov. 19, 2009; 4 pages.

* cited by examiner

*Primary Examiner* — Robert B Davis
(74) *Attorney, Agent, or Firm* — Foley & Lardner LLP

(57) ABSTRACT

The static mixer has a coupling section and a mixer housing in which mixer elements are arranged consecutively in the flow direction so as to be offset relative to one another by an angle, and are designed so as to apply an alternatingly directed rotation to the mixed material during the mixing operation. A mixer element has two transversal walls that are divided into sectors, the first transversal wall comprising sectors that are separated by an inflow separating wall directed to the inlet, and a separating wall directed to the outlet, the transitions between the sectors and the separating wall forming respective breakaway edges, the separating wall being arranged at an angle relative to the inflow separating wall, and the second transversal wall, which is divided into sectors, having an outflow separating wall directed to the outlet. Such a mixer allows a more efficient mixture particularly of very quickly reacting components and is also suitable for small dimensions as used in medicine.

18 Claims, 4 Drawing Sheets

STATIC MIXER

CROSS-REFERENCE TO RELATED PATENT APPLICATIONS

Switzerland Priority Application 01855/08, filed Nov. 27, 2008 including the specification, drawings, claims and abstract, is incorporated herein by reference in its entirety. This application is the US National Phase application of PCT/CH2009/000371 filed Nov. 19, 2009, which is incorporated herein in its entirety as if fully set forth herein.

BACKGROUND OF THE INVENTION

The present invention relates to a static mixer, comprising a mixer housing, a coupling section, and mixer elements arranged in the mixer housing, according to the preamble of claim 1. A mixer of this kind is known from U.S. Pat. No. 5,944,419.

SUMMARY OF THE INVENTION

Both in medicine and in engineering, adhesives in the form of hardly miscible liquids and/or more particularly of very quickly reacting components are increasingly being applied where an intermediate layer or film immediately forms between the components.

On the background of the aforementioned prior art, it is an object of the present invention to provide a mixer whose mixer elements ensure a more efficient thoroughly mix, even of very quickly reacting components and that is suitable for small dimensions as used in medicine. This object is attained by the mixer according to claim 1. Further advantageous embodiments are defined in the dependent claims.

BRIEF DESCRIPTION OF THE DRAWINGS

The invention will be explained in more detail hereinafter with reference to drawings of an exemplary embodiment.

DETAILED DESCRIPTION OF THE PREFERRED EMBODIMENTS

Figure 1:
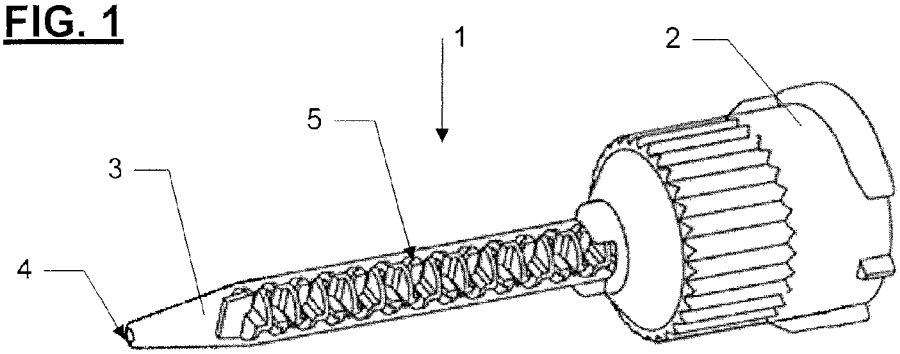
FIG. 1 shows an exemplary embodiment of a mixer according to the invention in a partly sectioned perspective view.

FIG. 1 shows a mixer 1 according to the invention with coupling section 2, mixer housing 3 with outlet 4, and all of the mixer elements 5. The coupling section may be designed in any way, i.e. it may be a part of a bayonet connection, a plug and socket connection, or a screw connection.

Figure 2:
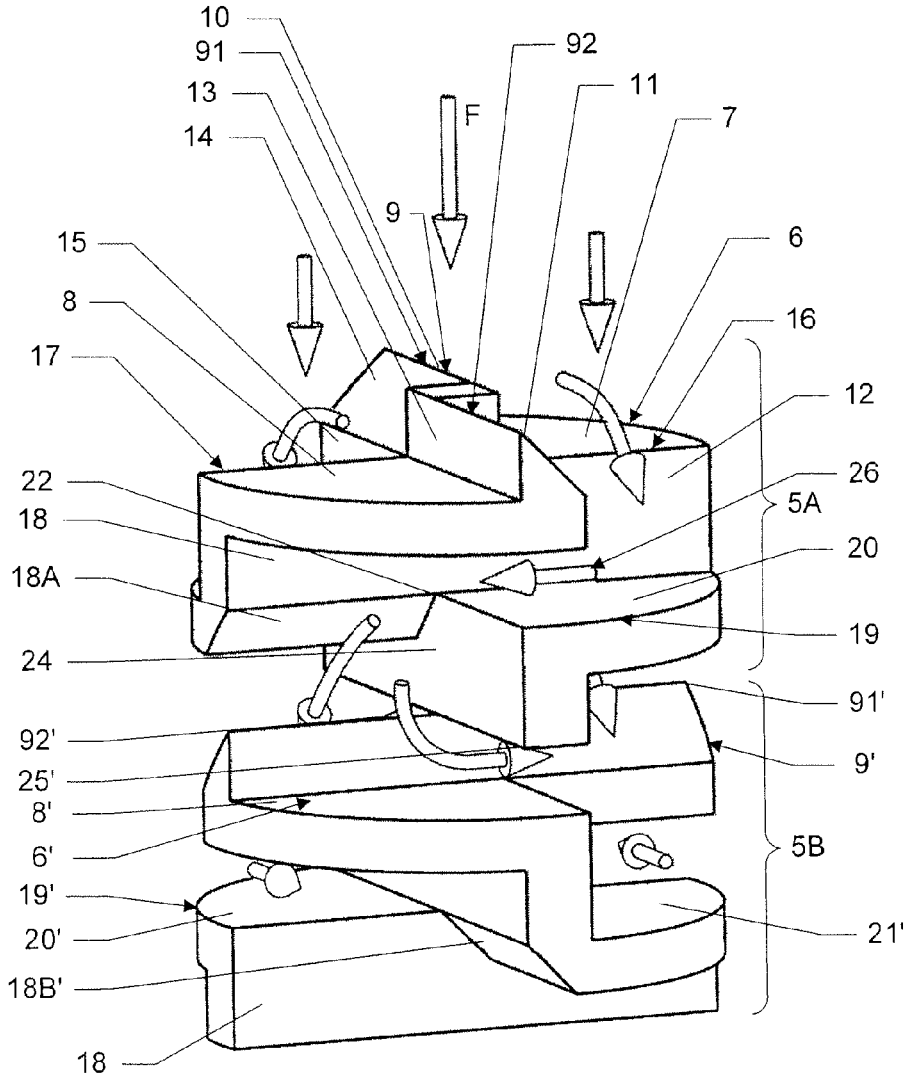
FIG. 2 shows two mixer elements of the mixer of FIG. 1 schematically and in an enlarged detail, FIG. 3 schematically shows the stepwise mixing operation.
Figure 3:
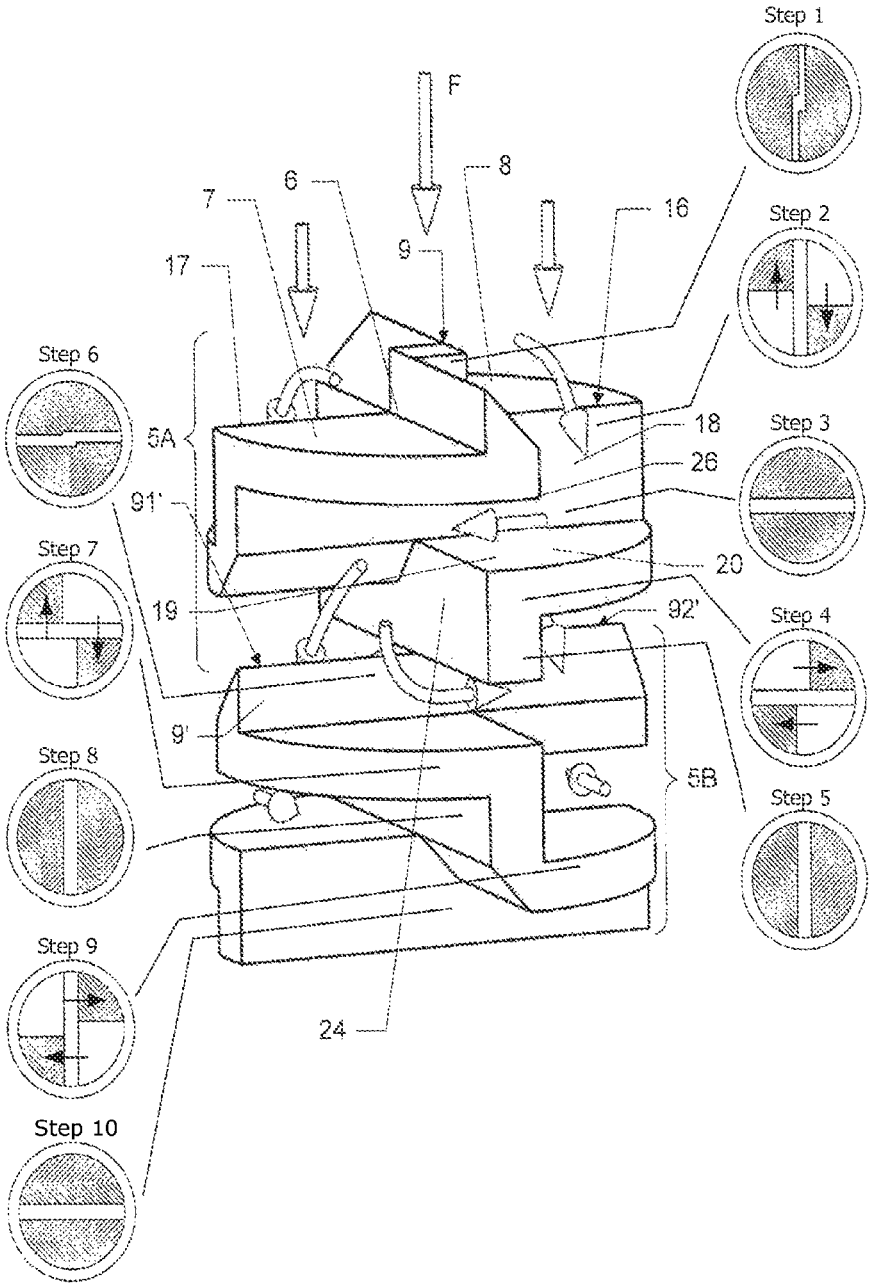
Figure 4:
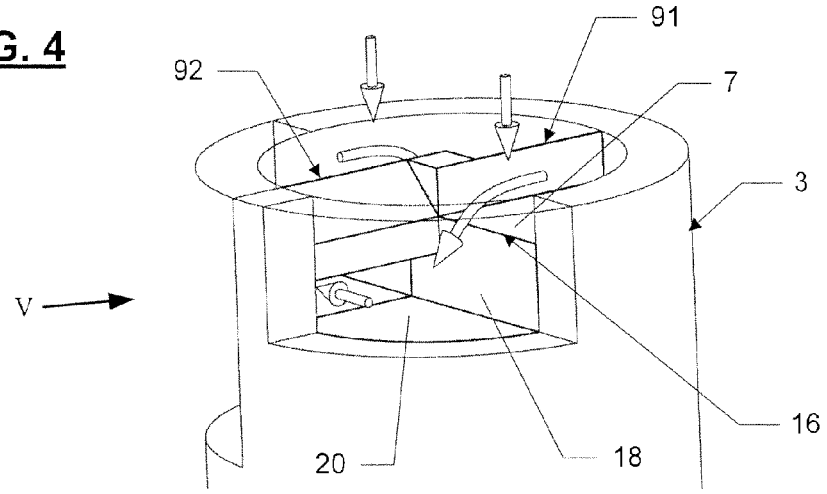
FIGS. 4-6 show single steps of the mixing operation, and FIG. 7 schematically shows the offset angle of the mixer elements shown in FIG. 2, in particular the offset angle between the mixer elements and respective offset angles between individual separating walls and transversal walls of a mixer element, respectively.
Figure 5:
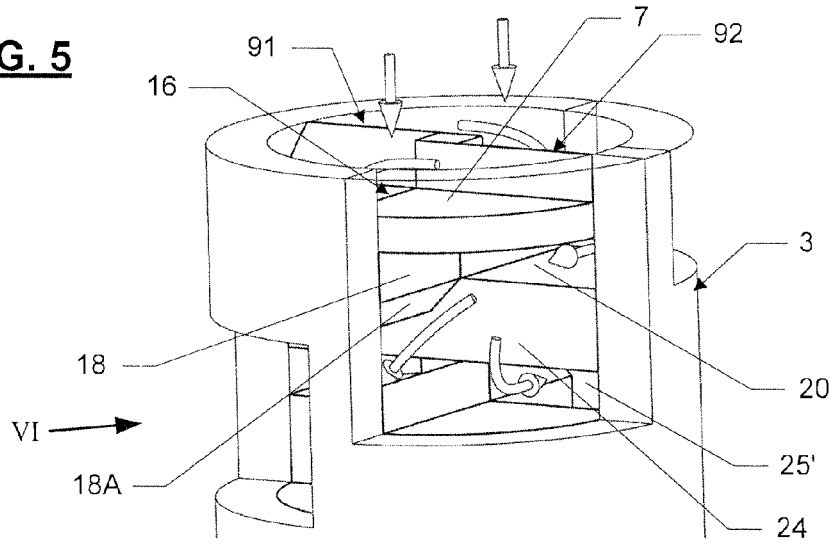
Figure 6:
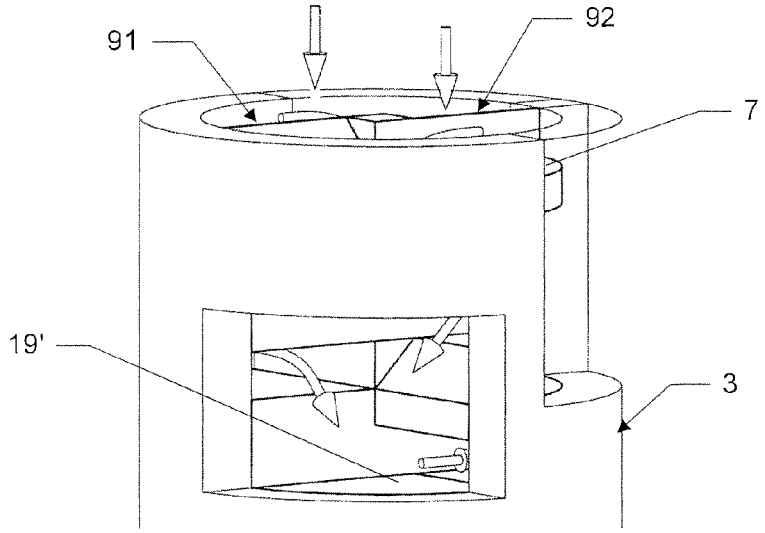

In FIG. 2, two mixer elements 5A and 5B are illustrated which are arranged in a housing that is not shown. The flow direction is indicated by arrow F. Seen in the flow direction, a mixer element has a first transversal wall 6 which in the present case is divided into two sectors 7 and 8, the sectors being arranged opposite each other in this example and each encompassing an angle of 90°. The two sectors are separated from each other by a two-part inflow separating wall 9 that is directed to the inlet and has a triangular profile and as a result of which one half 91 of inflow separating wall 9 is arranged such that one side 10 thereof descends approximately perpendicularly to the corresponding sector 7 and its other side 11 slants down toward opening 12 between the two sectors. Analogously, the other separating wall portion 92 is arranged point-symmetrically thereto, perpendicular side 13 descending toward sector 8, and slanted side 14 descending toward opening 15. The free edges 16 and 17 of sectors 7 and 8 form breakaway edges for a material flowing therethrough.

The two breakaway edges 16 and 17 merge into a separating wall 18 that is directed to the outlet and has respective bevels 18A, 18B at both free ends and is followed by second transversal wall 19 which in turn is divided into two sectors 20 and 21, sector 21 not being visible in FIG. 2. The two free edges 22 and 23 of sectors 20 and 21 are also breakaway edges, breakaway edge 23 not being visible in FIG. 2. The two breakaway edges 22 and 23 merge into outflow separating wall 24 directed to the outlet.

Second mixer element 5B is essentially composed of individual components corresponding to those of first mixer element 5A whereas these individual components are each mirror-inverted relative to a plane passing perpendicularly through the center of the respective inflow separating walls 9, 9' of mixer elements 5A, 5B. This means that the separating wall portions 91', 92' of inflow separating wall 9' that are correspondingly provided on mixer element 5B are mirror-inverted such that the slanted sides of inflow separating wall 9' of mixer element 5B are directed to the opposite orientation sides of the corresponding slanted sides of inflow separating wall 9 on mixer element 5A. Relative to these laterally reversed and thus oppositely oriented inclined side surfaces of inflow separating wall 9', other individual components of mixer element 5B are arranged in a corresponding manner as on mixer element 5A, in particular sectors 7' (not shown) and 8' of transversal wall 6' and sectors 20' and 21' of second transversal wall 19'. Other individual components of mixer element 5B which directly correspond to the previously described individual components of mixer element 5A but are not explicitly mentioned in the present description are analogously designated in the Figures by a corresponding reference numeral and a following prime symbol '''. In a preferred embodiment of this mirror-inversion of consecutive mixer elements 5A, 5B, according to the present example, mixer element 5B is designed essentially mirror-symmetrically to mixer element 5A with respect to a symmetry plane that passes perpendicularly through the center of inflow separating wall 9' of mixer element 5A. In particular, this implies a mirror-symmetrical design of the corresponding individual components on individual mixer elements 5A, 5B.

Second mixer element 5B is rotationally offset relative to first mixer element 5A so that in the present exemplary embodiment, the respective inflow separating walls 9, 9' are aligned essentially perpendicularly to one another and sectors 7, 7', 8, 8', 20, 20', 21, 21', respectively, are congruent in the flow direction F.

Figure 7:
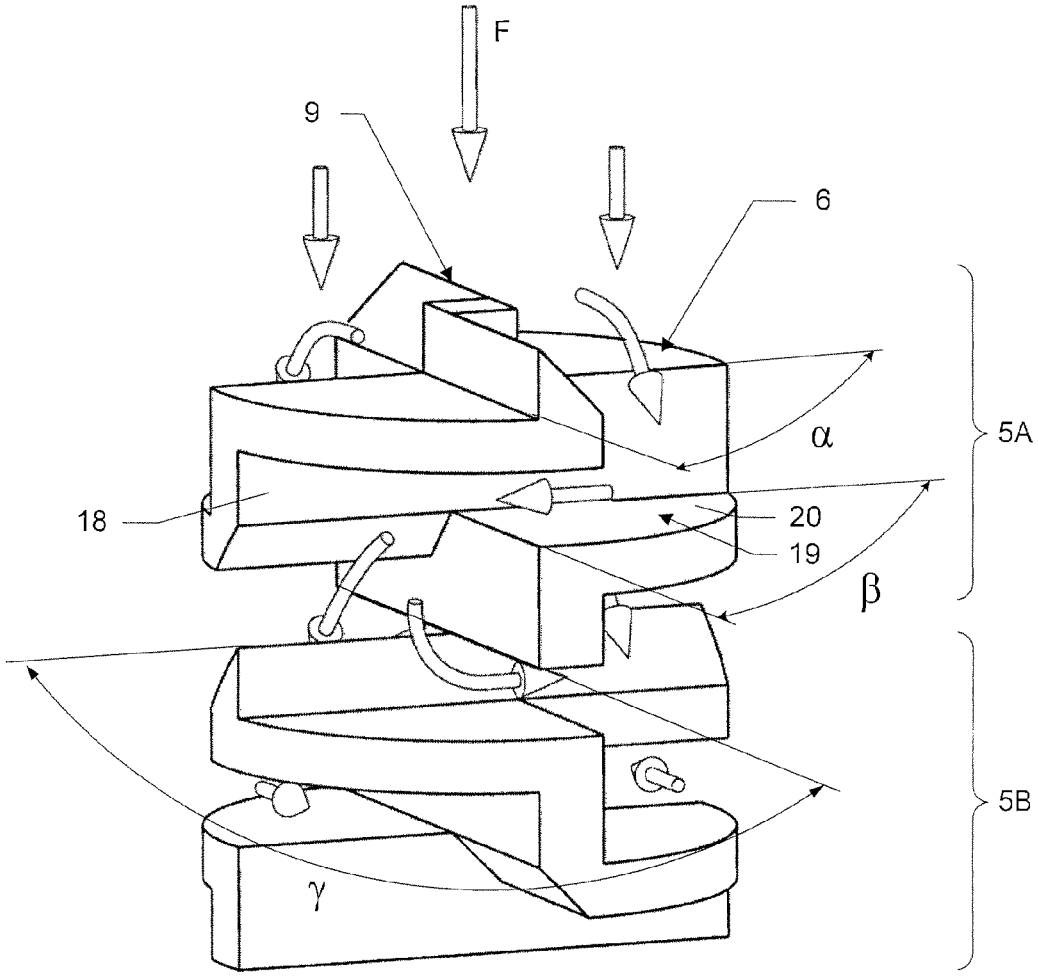

The rotational offset of mixer elements 5A and 5B is visible more clearly in FIG. 7, which corresponds to the illustration of mixer elements 5A and 5B in FIG. 2 but where angles are indicated by means of which the angular offset of the previously described individual components is specified. It is shown therein that separating wall 18 is offset relative to inflow separating wall 9 by an angle $\alpha$, here=90°, and second transversal wall 19 with sectors 20 and 21 (not shown) is offset relative to first transversal wall 6 by an angle $\beta$, here=90°. It is further visible in FIG. 7 that second mixer element 5B is also offset by an angle γ, here=90°, relative to first mixer element 5A.

According to the invention, as a result of the described offset arrangement of the respective individual components of mixer elements 5A, 5B, a rotation is applied to the material flowing therethrough which essentially corresponds to the creation of an angular spin in the material. Due to the described mirror-inverted design of mixer elements 5A, 5B, the rotation applied by a particular mixer element 5B to the material flowing therethrough alternates in direction as compared to the preceding mixer element 5A. By this reversal of the direction of rotation applied by any two consecutive mixer elements 5A, 5B to the material flowing therethrough, a particularly effective mixture of the latter is obtained. Outlet separating wall 24 is arranged in parallel to inlet separating wall 9 but may also exhibit an offset angle.

In addition, on one hand, an effective mixture is achieved by the use of two transversal walls and of breakaway edges 16, 17 and 22, 23 which cause a shearing and swirling action. On the other hand, an effective mixture is provided by restrictions 25 and 26 resulting along separating wall 18 at the respective transitions from the surface sections comprising breakaway edges 16, 17 and the surface sections below sectors 20, 21, which cause an angular channeling of the material flow.

Hereinafter, the mixing operation is explained with reference to FIGS. 3 and 4 to 6. For the sake of simplicity, the components to be mixed, which may be liquid or pasty and reach the mixer element through the mixer inlets, will be called "material." Steps 1 to 5 are explained with reference to mixer element 5A and steps 6 to 10 with reference to mixer element 5B. It follows from the Figures that in second mixer element 5B, the material flows in the opposite rotational sense of the first mixer element, the outlet edge also being offset relative to the outlet edge of the preceding element, in this example by 90°.

As the material reaches the first mixer element, it is divided into two partial streams by separating wall 9, see step 1. Next, the first transversal wall 6 restricts the cross-section to respective quarters of the total cross-sectional area. Subsequently, the partial streams reach breakaway edges 16 and 17, respectively, these breakaway edges causing a swirling of the flow, see step 2. In step 3, the material is again distributed over half the diameter and flows through a cross-sectional restriction 25 between the lower edge of sector 12 and the following breakaway edge 23 before reaching the second transversal wall 19 according to step 4. Deflected by this transversal wall, the material flows past breakaway edges 22 and 23 and restriction 26 and in step 5 again spreads over half the diameter before reaching the first separating wall 9' respectively 91' and 92' of the following mixer element 5B.

The following steps 6 to 10 are analogous to steps 1 to 5 with the difference that the separating and breakaway edges of the following mixer element 5B are offset 90° relative to those of the preceding mixer element 5A. By the mutually mirror-inverted design of mixer elements 5A, 5B, it is now ensured that the spinning effect of this mixer element and the resulting sense of rotation applied to the mixed material are directed oppositely to the preceding mixer element. Due to the fact that the second mixer element is offset 90° relative to the outlet separating wall of the first mixer element, four partial streams of the initial medium are flowing in the second mixer element. Consequently, four partial streams are now being mixed. In the following mixer element, 8 partial streams result, etc. Due to the turbulences, the partial streams mix very quickly, and a homogenously mixed material results. Depending on the material, 6 to 20 mixer elements are generally sufficient.

Based on this exemplary embodiment, modifications and enhancements in the design of the mixer elements are possible. Thus, the transversal walls may be divided into three instead of two sectors that are arranged at an angle of 120° relative to each other, or else into four symmetrically arranged sectors. Also, the transversal walls may be arranged otherwise than perpendicularly to the longitudinal extension of the mixer and include an angle α of 20° to 90° with the center axis, and individual transversal walls may exhibit different angles. This is also true analogously for the separating walls which do not necessarily have to be arranged in parallel to the longitudinal center axis and may include an angle β of 20 to 90° therewith. Also, the offset angle γ between the individual mixer elements may have a value of 1° to 179°.

In the exemplary embodiment, a cylindrical mixer housing has been disclosed, but rectangular or square mixer housings may also be contemplated and the external shape of the mixer elements is to be adapted thereto.

The invention claimed is:

1. A static mixer, comprising:

a mixer housing;

a coupling section; and mixer elements arranged in the mixer housing, the mixer elements, seen in a flow direction, being consecutively arranged so as to be offset relative to one another by an angle (γ), and a mixer element including at least one transversal wall that is divided into sectors which are separated by a separating wall directed to an inlet, wherein a mixer element has two transversal walls that are divided into sectors, the first transversal wall including sectors that are separated by an inflow separating wall directed to the inlet, and a separating wall directed to the outlet, the transitions between the sectors and the separating wall forming respective breakaway edges, the separating wall being arranged at an angle (α) relative to the inflow separating wall, the second transversal wall, which is divided into sectors including an outflow separating wall directed to the outlet and being offset by an angle (β) relative to the first transversal wall, and the consecutive mixer elements being designed so as to apply an alternatingly directed rotation effect to a material to be mixed during a mixing operation, wherein the inflow separating wall is divided into respective separating wall portions in front of a sector of the first transversal wall and has a triangular cross-section, one side being perpendicular to the sector and the other side being slanted.

2. The static mixer of claim 1, wherein a restriction is formed at the transition from the surfaces of the separating walls which include the breakaway edges to the surfaces located below the sectors.

3. The static mixer of claim 1, wherein the separating wall portions on at least two consecutive mixer elements are mirror-inverted relative to each other so that corresponding slanted sides of the respective inflow separating walls on the consecutive mixer elements are oppositely directed.

4. The static mixer of claim 1, wherein on at least two consecutive mixer elements, corresponding parts are provided in an essentially mirror-inverted configuration relative to a plane that passes perpendicularly through the center of the respective inflow separating walls of the mixer elements.

5. The static mixer of claim 1, wherein the angles (α, β) include a range of 20° to 160° and the angle (γ) includes a range of 1° to 179°.

6. The static mixer of claim 1, wherein the angles ($\alpha$, $\beta$, $\gamma$) are each equal to 90°.

7. The static mixer of claim 1, wherein the separating walls are each parallel to the longitudinal center line of the mixer and the first and second transversal walls are arranged perpendicularly thereto.

8. The static mixer of claim 1, wherein the first and second transversal walls each include two sectors having each an opening angle of 90°.

9. The static mixer of claim 1, wherein the transversal walls each include three sectors having each an opening angle of 60°.

10. The static mixer of claim 1, wherein the inflow separating wall is arranged in parallel to the outflow separating wall.

11. A static mixer, comprising:

a mixer housing;

a coupling section; and mixer elements arranged in the mixer housing, the mixer elements, seen in a flow direction, being consecutively arranged so as to be offset relative to one another by an angle ($\gamma$), and a mixer element including at least one transversal wall that is divided into sectors which are separated by a separating wall directed to an inlet, wherein a mixer element has two transversal walls that are divided into sectors, the first transversal wall including sectors that are separated by an inflow separating wall directed to the inlet, and a separating wall directed to the outlet, the transitions between the sectors and the separating wall forming respective breakaway edges, the separating wall being arranged at an angle ($\alpha$) relative to the inflow separating wall, the second transversal wall, which is divided into sectors including an outflow separating wall directed to the outlet and being offset by an angle ($\beta$) relative to the first transversal wall, and the consecutive mixer elements being designed so as to apply an alternatingly directed rotation effect to the material to be mixed during a mixing operation, and wherein the transversal walls each include three sectors having each an opening angle of 60°.

12. The static mixer of claim 11, wherein the inflow separating wall is divided into respective separating wall portions in front of a sector of the first transversal wall and has a triangular cross-section, one side being perpendicular to the sector and the other side being slanted.

13. The static mixer of claim 12, wherein the separating wall portions on at least two consecutive mixer elements are mirror-inverted relative to each other so that corresponding slanted sides of the respective inflow separating walls on the consecutive mixer elements are oppositely directed.

14. The static mixer of claim 11, wherein on at least two consecutive mixer elements, corresponding parts are provided in an essentially mirror-inverted configuration relative to a plane that passes perpendicularly through the center of the respective inflow separating walls of the mixer elements.

15. A static mixer, comprising:

a mixer housing;

a coupling section; and mixer elements arranged in the mixer housing, the mixer elements, seen in a flow direction, being consecutively arranged so as to be offset relative to one another by an angle ($\gamma$), and a mixer element including at least one transversal wall that is divided into sectors which are separated by a separating wall directed to an inlet, wherein a mixer element has two transversal walls that are divided into sectors, the first transversal wall including sectors that are separated by an inflow separating wall directed to the inlet, and a separating wall directed to the outlet, the transitions between the sectors and the separating wall forming respective breakaway edges, the separating wall being arranged at an angle ($\alpha$) relative to the inflow separating wall, the second transversal wall, which is divided into sectors including an outflow separating wall directed to the outlet and being offset by an angle ($\beta$) relative to the first transversal wall, and the consecutive mixer elements being designed so as to apply an alternatingly directed rotation effect to the material to be mixed during a mixing operation, and wherein the inflow separating wall is arranged in parallel to the outflow separating wall.

16. The static mixer of claim 15, wherein the inflow separating wall is divided into respective separating wall portions in front of a sector of the first transversal wall and has a triangular cross-section, one side being perpendicular to the sector and the other side being slanted.

17. The static mixer of claim 16, wherein the separating wall portions on at least two consecutive mixer elements are mirror-inverted relative to each other so that corresponding slanted sides of the respective inflow separating walls on the consecutive mixer elements are oppositely directed.

18. The static mixer of claim 15, wherein on at least two consecutive mixer elements, corresponding parts are provided in an essentially mirror-inverted configuration relative to a plane that passes perpendicularly through the center of the respective inflow separating walls of the mixer elements.

* * * * *